US005890331A

United States Patent [19]

Hope

[11] Patent Number: 5,890,331

[45] Date of Patent: Apr. 6, 1999

[54] WINDOW DRAIN TUBE

[76] Inventor: Robert Hope, 131 Chester Ave., Toronto, Ontario, Canada, M4K 2Z8

[21] Appl. No.: 763,413

[22] Filed: Dec. 11, 1996

[51] Int. Cl.[6] ..... E06B 7/14

[52] U.S. Cl. ..... 52/209; 52/204.52; 52/302.7

[58] Field of Search ..... 52/204.52, 209, 52/302.7, 786.1, 786.13

[56] References Cited

U.S. PATENT DOCUMENTS

| | | | |
|---|---|---|---|
| 2,570,336 | 10/1951 | Fouts | 52/209 |
| 3,248,832 | 5/1966 | Leue et al. | 52/209 |
| 4,627,206 | 12/1986 | Cox | 52/209 |
| 4,691,487 | 9/1987 | Kessler | 52/209 |
| 5,044,121 | 9/1991 | Harbom et al. | 52/209 X |

FOREIGN PATENT DOCUMENTS

| | | | |
|---|---|---|---|
| 2250888 | 6/1975 | France | 52/209 |
| 1260111 | 2/1968 | Germany | 52/209 |
| 302755 | 10/1965 | Netherlands | 52/209 |
| 123822 | 5/1947 | Sweden | 52/209 |

*Primary Examiner*—Carl D. Friedman
*Assistant Examiner*—Timothy B. Kang
*Attorney, Agent, or Firm*—Duane, Morris & Heckscher

[57] ABSTRACT

Door and window constructions are provided which include a drainage channel fitted with a tubular member for providing a cost effective method of draining rain water which can sometimes seep along the window into its support frame.

19 Claims, 1 Drawing Sheet

WINDOW DRAIN TUBE

FIELD OF THE INVENTION

This invention relates to composite door constructions and windows, and more particularly to means for draining away rain water which typically seeps between the window and its supporting stricture.

BACKGROUND OF THE INVENTION

Many of today's commercial and residential doors contain ornamental glass panels and windows. Such doors often contain hollow panels, laminated materials, and foam insulation. Rain water has been known to seep around the glass surfaces of these constructions and can damage the interior of the door. This has sometimes resulted in water being directed to the wooden surfaces in the interior of the house.

Efforts have been made to redirect water seepage out of the interior compartments of the door to the outside of the house. One such method, provided by Novatec, Inc. in its extruded frame doors, is to machine a pair of channels through the thermoplastic extruded frame. These channels meet at a 90° angle to transport rain water from the door's interior to the exterior of the house. This design, however, requires a generous thickness of extruded material for the support frame and is rather expensive.

Accordingly, there remains a need for a exterior door drainage system that is easy to employ, cost effective and provides a greater degree of aesthetic design features for extruded door materials.

SUMMARY OF THE INVENTION

This invention provides door constructions and windows which, in a first embodiment, are represented by a door panel, window and support frame connecting the window and door panel together. The support frame has a drainage channel having a first end in communication with a window receiving pocket and a second end in communication with an exterior environment. The drainage channel also has a lateral opening in communication with the door panel receiving pocket. Into the drainage channel of this invention is inserted a tubular member which forms a drainage tunnel for the passage of fluids, such as rain water. By inserting a tube into the drainage channel, water can be effectively sealed from entering into the lateral opening in the channel without wasting space or requiring expensive machining steps. The inserted tube of this invention greatly reduces the preparation of such door drainage systems and lends itself to more creative, and thinner, door constructions. The support frame can be made from thinner thermoplastic extrusions than present designs can accommodate, because the wall thickness between the drainage channel and the door panel cavity can be as thin as the designer wishes, or can be eliminated entirely.

This invention is not limited to door frames, and can just as easily apply to windows. In these further embodiments, the window receiving cavity can be drained by a tubular member in substantially the same fashion as described above. Such a window construction can substantially eliminate water settling into the window receiving channel and possibly entering the building or its walls. The tube can be used even with extruded frames having complex interconnecting cavities, since the tube is substantially water-tight and provides a rather direct and efficient drainage system.

BRIEF DESCRIPTION OF THE DRAWINGS

The accompanying drawings illustrate preferred embodiments of he invention according to the practical application of the principles thereof, and in which.

DETAILED DESCRIPTION OF THE INVENTION

Door and window constructions are provided by this invention which are useful for residential and commercial applications. These products use tubular members for providing drainage, while simultaneously facilitating the use of less expensive, thinner extruded shapes and designs with more interesting aesthetic features. As used herein, the terms "tubular" or "tube" mean conduits having geometrical cross-sections, such as circular, oval or square, as well as asymmetrical cross-sections, such as tear-drops.

Figure 2:
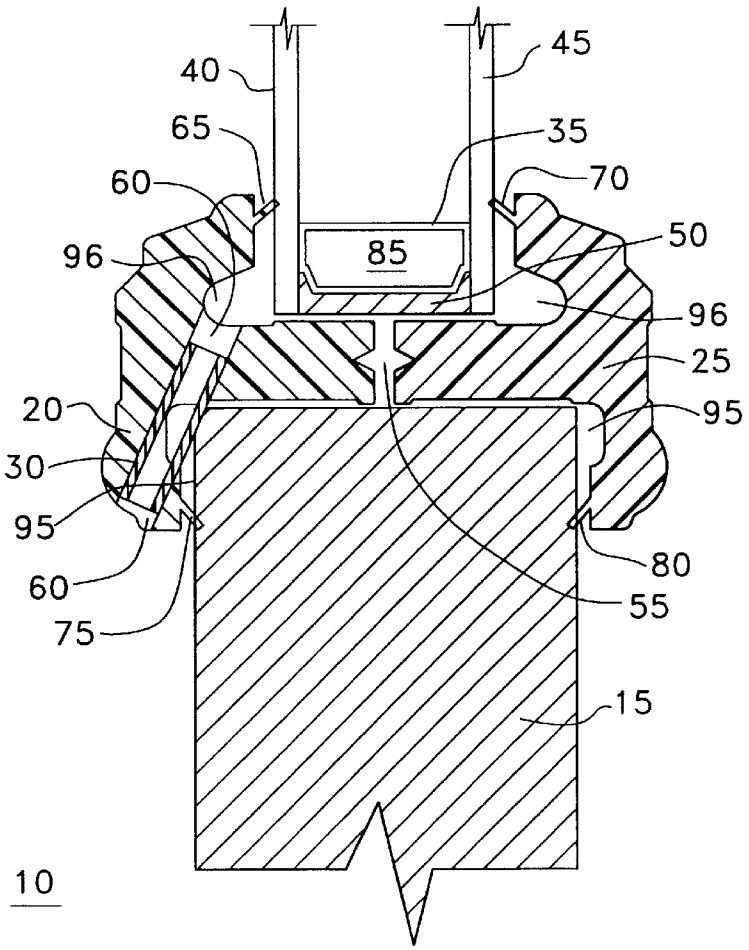
FIG.2: is a partial cross-sectional view of the preferred door construction of this invention.
Figure 1:
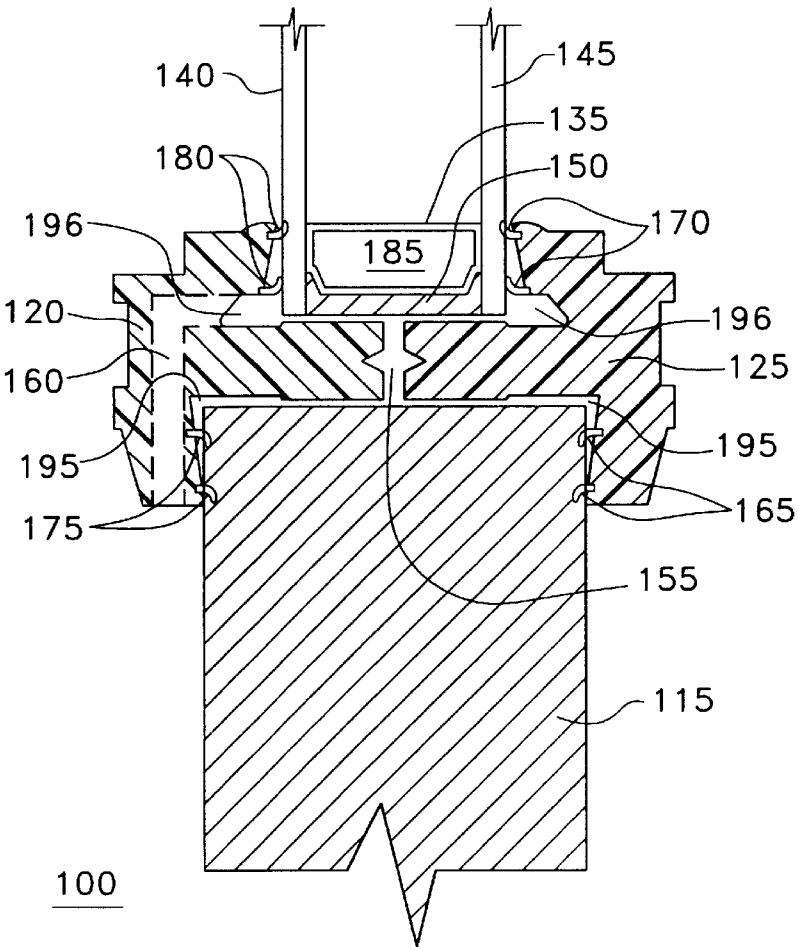
FIG. 1: is a partial cross-sectional view of a prior art door construction.

With reference to the figures, and particularly to FIGS. 1 and 2 thereof, there is shown a prior art door construction 100 and preferred door construction 10 of this invention. With respect to prior art door construction 100, the typical elements include a window having a pair of glass panels 140 and 145 separated by an aluminum spacer 135, which optionally contains a desiccant 185 for eliminating water and water vapor from between the glass panels 140 and 145. The lower surface of the window is preferably sealed with a rubber, or synthetic rubber, sealant 150.

Similarly, with respect to the preferred door construction 10 of this invention, a window is provided having glass panels 40 and 45 separated by a preferred aluminum spacer 35 which optionally contains a desiccant 85. This window is provided with a rubber, or synthetic rubber, seal 50, which is preferably made from polybutyl-sulfide. The window of the prior art door construction 100 is inserted into its window receiving pocket 196. Similarly, the window of the preferred embodiment is inserted into its window receiving pocket 96.

The prior art door construction 100 typically includes a support frame having support frame portions 120 and 125. Similarly, the present door construction 10 includes support frame portions 20 and 25. These support frame portions 20 and 25 can be manufactured from polyvinyl chloride extrusions which are hollow, or filled with polyvinyl chloride foam, which is preferably co-extruded. On the lower side of the support frame of both door constructions 10 and 100, are located door panels 15 and 115. These door panels 15 and 115 are inserted into a door panel receiving pockets 95 and 195 which are sized to snugly receive them.

It has beer known from experience that rain water often enters into the prior art door construction 100 by bypassing the resilient fins 180 and seeping into the window receiving pocket 196. Occasionally this water travels through the connecting cavity 155 and into the door panel receiving pocket 195.

The door panels 15 and 115 are typically made from steel-clad foam or hollow structures which are both lightweight and durable. However, if rain water seeps through connecting cavity 155, it tends to settle into the foam material or in the bottom of the steel clad cavity. This can lead to corrosion, and sometimes leakage into the home, resulting in further water damage. While prior art resilient fins 180, 175, 170 and 165 have been known to prevent most water from seeping into the door construction 100, such measures have not been entirely successful. Accordingly, the prior art has fashioned a machined drainage channel 160 in the outside-facing support frame portion 120. This drainage channel 160 typically requires two connecting holes or channels of about 3/16"×½" in size to be drilled or milled into the frame from two directions. This practice requires that the thickness of the frame be of sufficient size to allow the hole to be drilled without breaking through the sidewalls of the frame. Such machining operations are very expensive.

In an important aspect of this invention, the drainage channel 60 of door construction 10 is provided by a single, preferably straight, milled hole to the outside of the building. The milled drainage channel 60 can be prepared by machining a hole from the exterior of the support frame portion 20 into the window receiving pocket 96. The typical channel outer cross-section should be about 3/16"×½" by ¾" deep with a wall thickness of about 1/32". When drilled at an oblique angle to the door panel 15, as shown in FIG. 2, the hole will break through the sidewall of drainage channel 60. This causes he drainage channel 60 to openly communicate with the door panel receiving pocket 95.

Next, a length of flexible tubing is prepared. The preferred flexible tubing can be made from a thermoplastic material, preferably selected from polyethylene, polypropylene, polyurethane, or polyvinyl-chloride. Currently, the most preferable material is polyurethane. Alternatively, the drainage channel can be filled with a flexible polymeric material or rubber and later milled or drilled to provide a hole.

It is highly desirable to have a substantially watertight seal between the outside of the flexible tube 30 and the inner dimension of the drainage channel 60. This can be accommodated in several ways. For example, the outer dimension of the flexible tube 30 can be manufactured to be about the same dimension as the inner surface of the drainage channel 60. Additionally, the flexible tube 30 can be made of a compressible grade of plastic, and provided with an outside dimension which is slightly greater than the size of the drainage channel 60. Finally, a suitable sealant material, such as silicone or epoxy can be applied if desirable to seal only the edges of the flexible tube 30, or substantially along its length.

The inside dimension of the flexible tube 30 should be sufficiently large so as to allow water, especially rain water, to flow through the tube. Alternatively, the interior of the tube can be treated with hydrophilic or hydrophobic coatings to aid in drainage or coalescence of water droplets. The wall thickness of the tube 30 should be small enough to provide some compressibility so as to both grip the interior wall of the drainage channel 60 and provide some measure of forgiveness when contacting the corner of door panel 15, if this should occur. Alternatively, the flexible tube 30 could be made of a soft, or spongy, polymeric material.

The length of the flexible tube 30 is also rather important. The preferred tube 30 should be long enough so as to allow a complete seal at the breakthrough portion of the frame which opens up to the door panel receiving pocket 95. The tube 30 should be long enough to provide sufficient engagement with the channel wall of the drainage channel 60 at least at both ends of the drainage channel 60 to secure the connection, while providing a preferred water-tight seal. When assembled in the door, the preferred flexible tube 30 may contact the door panel 15 so as to partially compress its sidewall without damaging the door panel 15 or seriously impeding the drainage of rain water.

In another feature of the present invention, integral fins 65, 70, 75 and 80 are provided along support frame portions 20 and 25. Preferably, these fins are melt bonded to, comolded or coextruded with the support frame. In the most preferred embodiment, the fins 65, 70, 75 and 80 are made of the same material as the support frame portions 20 and 25 and are coextruded polyvinyl-chloride. This is similar to prior art resilient fins 165, 170, 175 and 180 which are typically flexible plastic coextruded with the support frame portions 120 aid 125. Alternatively, water sealing can be achieved by using hot melt foamed adhesive, caulking compounds or rubber seal which is adherent to polyvinyl chloride.

This invention equally applies to windows of all constructions, including single and double hung, sliders, bay and bow. Such windows can include wood, metal, plastic or composite frames having window cavities therein. Plastic frames can include foam-filled or extruded hollow cavities. When used with this invention, such windows include a tubular member inserted through a milled or drilled channel for permitting water to drain from the window cavity to the exterior. The materials described in connection with door embodiments are equally applicable here.

From the foregoing, it can be realized that this invention provides improved door constructions which provide greatly simplified manufacturing techniques for assembly. This invention also allows for thinner support frame wall sections, offering more unique and aesthetically attractive designs at a lower cost. Although various embodiments have been illustrated, this was for the purpose of describing, but not limiting the invention. Various modifications, which will become apparent to one skilled in the art, are within the scope of this invention described in the attached claims.

We claim:

1. A door construction including a door panel, a window, and a support frame connecting said window to said door panel; said support frame having a window receiving pocket and a door panel receiving pocket therein, said door construction further comprising:

a first connecting cavity located through said support frame between said window receiving pocket and said door panel receiving pocket;

a drainage channel having a first end in communication with said window receiving pocket and a second end in communication with an exterior environment; said drainage channel having a lateral opening in communication with said door panel receiving pocket;

a tubular member disposed within said drainage channel, said tubular member having an outside dimension in contact with a wall of said drainage channel and an inside dimension large enough for passing a fluid therethrough, said tubular member being compressible by a door panel inserted within said receiving pocket without seriously impeding the passing of said fluid through said tubular member.

2. The door construction of claim 1 wherein said tubular member comprises a flexible drainage tube.

3. The door construction of claim 2 wherein said flexible drainage tube comprises a thermoplastic tube having an outside dimension which forms a substantially water-tight seal with said drainage channel so as to reduce the penetration of liquid water between said outside dimension of said thermoplastic tube and said drainage channel.

4. The door construction of claim 3 wherein said thermoplastic tube comprises a thermoplastic material selected from: polyethylene, polypropylene, polyurethane or polyvinyl-chloride.

5. The door construction of claim 1 wherein said tubular member is disposed in contact with a portion of said door panel.

6. The door construction of claim 1 wherein said tubular member is a polyurethane tube having a round cross-section.

7. The door construction of claim 6 wherein said support frame comprises a polyvinyl chloride shell containing a foam material.

8. The door construction of claim 1 wherein said drainage channel comprises a relatively straight channel disposed through said support frame.

9. The door construction of claim 8 wherein said lateral opening is disposed about in the middle of said channel.

10. A door construction including a door panel, a window, and a support frame connecting said window to said door panel; said support frame having a window receiving pocket, a door panel receiving pocket and sealing means for reducing penetration of rain water from entering into said window receiving pocket and said door panel receiving pocket, said door construction further comprising:

a first connecting cavity located between said window receiving pocket and said door panel receiving pocket in said support frame;

a drainage channel disposed through said support frame having a first end in communication with said window receiving pocket and a second end in communication with an exterior environment, said drainage channel having a side wall opening in communication with said door panel receiving pocket;

a tubular member disposed within said drainage channel, said tubular member having an outside dimension which forms a substantially water-tight seal with said drainage channel and an inside dimension which is large enough to drain rain water to said exterior environment, said tubular member being compressible by a door panel inserted within said receiving pocket without seriously impeding the passing of said rain water through said tubular member.

11. The door construction of claim 10 wherein said tubular member comprises a polyurethane tube having a resilient wall surface disposed in contact with said door panel.

12. The door construction of claim 11 wherein said drainage channel comprises a relatively straight channel through said support frame.

13. The door construction of claim 12 wherein said tube is disposed in contact with said door panel so as to compress a portion of its resilient wall surface.

14. The door construction of claim 10 wherein said tubular member is disposed at an oblique angle relative to said door panel.

15. A method of providing a drainage system to a door construction, said door construction including a door panel, a window and a support frame connecting said window to said door panel; said support frame having a window receiving pocket and a door panel receiving pocket therein, said method comprising:

providing a relatively straight opening through said support frame to provide a drainage channel, said drainage channel being in open communication with said window receiving pocket, said door panel receiving pocket and an exterior environment; and inserting a tubular member within said drainage channel so as to provide a conduit for rain water between said window receiving pocket and said exterior environment so as to permit drainage of rain water which seeps into said window receiving pocket, said tubular member being compressible by a door panel inserted within said receiving pocket without seriously impeding the passing of said rain water through said tubular member.

16. The method of claim 15 wherein said tubular member comprises a flexible polyurethane tube.

17. The method of claim 16 wherein said tubular member comprises an outside diameter in contact with a wall of said drainage channel so as to provide a substantially water-tight seal.

18. The method of claim 17 wherein said door panel is compressed against said polyurethane tube.

19. The method of claim 15 wherein said support frame comprises a polyvinyl chloride extrusion having a foam-filled cavity therein.

* * * * *